US006662478B1

(12) United States Patent
Virnig

(10) Patent No.: US 6,662,478 B1
(45) Date of Patent: Dec. 16, 2003

(54) GRADING BUCKET

(75) Inventor: Darin R. Virnig, Sartell, MN (US)

(73) Assignee: Virnig Manufacturing, Inc., Rice, MN (US)

( * ) Notice: Subject to any disclaimer, the term of this patent is extended or adjusted under 35 U.S.C. 154(b) by 0 days.

(21) Appl. No.: 10/081,138

(22) Filed: Feb. 22, 2002

Related U.S. Application Data

(60) Provisional application No. 60/271,361, filed on Feb. 23, 2001.

(51) Int. Cl.[7] ..... E02F 3/76; E02F 3/81

(52) U.S. Cl. ..... 37/267; 37/271; 37/407; 37/444; 37/903

(58) Field of Search ..... 37/266, 267, 268, 37/270, 271, 403, 407, 409, 410, 444, 903; 172/815

(56) References Cited

U.S. PATENT DOCUMENTS

| | | | | | |
|---|---|---|---|---|---|
| 574,567 | A | * | 1/1897 | Pepin | |
| 2,323,424 | A | | 7/1943 | Williams | |
| 2,652,639 | A | | 9/1953 | Kluckhohn | |
| 2,703,044 | A | | 3/1955 | Adair | |
| 3,182,410 | A | | 5/1965 | Schiavi | |
| 3,469,330 | A | | 9/1969 | Hood et al. | |
| D216,874 | S | | 3/1970 | Cline | D12/14 |
| 3,512,276 | A | | 5/1970 | Juhl | |
| 3,777,824 | A | | 12/1973 | Anderson et al. | 172/801 |
| 4,009,529 | A | | 3/1977 | Johnson | 37/117.5 |
| 4,074,448 | A | * | 2/1978 | Niemela | 37/41 |
| 4,111,268 | A | | 9/1978 | Frisbee | 172/805 |
| 4,216,833 | A | | 8/1980 | Fezatt et al. | 172/805 |
| 4,321,761 | A | | 3/1982 | Hedblom | 37/2 R |
| 4,360,980 | A | | 11/1982 | Jarvis | 37/117.5 |
| 4,521,980 | A | | 6/1985 | Solaja | 37/117.5 |
| 4,524,532 | A | * | 6/1985 | Browning | 37/117.5 |
| 4,655,297 | A | * | 4/1987 | Bourgeois, Jr. | 172/445.1 |
| 4,723,609 | A | | 2/1988 | Curtis | 172/815 |
| 4,819,349 | A | | 4/1989 | Mensch | 37/117.5 |
| 4,936,392 | A | | 6/1990 | Kitchin | 172/815 |
| D335,131 | S | | 4/1993 | Devaney | D15/10 |
| D335,883 | S | | 5/1993 | Devaney | D15/10 |
| 5,253,449 | A | * | 10/1993 | Webb et al. | 37/446 |
| 5,297,351 | A | * | 3/1994 | Cote | 37/232 |
| 5,386,652 | A | | 2/1995 | Ramun | 37/406 |
| D358,401 | S | | 5/1995 | Devaney | D15/10 |
| 5,596,825 | A | * | 1/1997 | Von Schalscha | 37/407 |
| 5,639,205 | A | | 6/1997 | Kaczmarczyk et al. | 414/723 |
| 6,243,975 | B1 | | 6/2001 | Gall | 37/407 |
| 6,457,268 | B1 | * | 10/2002 | Perry et al. | 37/403 |

* cited by examiner

*Primary Examiner*—Christopher J. Novosad
(74) *Attorney, Agent, or Firm*—Patterson, Thuente, Skaar & Christensen, P.A.

(57) ABSTRACT

In one embodiment, the present invention includes a grading blade disposed between a pair of holders. An adjusting mechanism is rigidly attached to the grading blade. A threaded connector is used to adjust the vertical position of the grading blade. Each holder is attached to a rear portion of a utility bucket, e.g., by welding. A plurality of gussets are attached to one of the holders and to the utility bucket, thereby providing further attachment and supported to the present grading assembly. The grading blade may be rotated, thereby using each of a pair of grading edges as desired. Moreover, the grading blade may be detached and repaired or replaced. When installed on a utility bucket, the present grading assembly allows precision grading to be conducted when driving in both forward and rearward directions. It is emphasized that this abstract is provided to comply with the rules requiring an abstract that will allow a searcher or other reader to quickly ascertain the subject matter of the technical disclosure. It is submitted with the understanding that it will not be used to interpret or limit the scope or meaning of the claims. 37 C.F.R. §1.72(*b*).

29 Claims, 5 Drawing Sheets

GRADING BUCKET

CROSS-REFERENCES TO RELATED APPLICATIONS

This application claims priority under 35 U.S.C. §119 (e) to, and hereby incorporates by reference, U.S. Provisional Application No. 60/271,361, filed Feb. 23, 2001

BACKGROUND OF THE INVENTION

1. Field of the Invention

This invention relates to attachments for utility vehicles, and, in particular, this invention relates to attachments for utility vehicles enabling precision grading to be conducted.

2. Background of the Invention

Utility vehicles are frequently used to grade topsoil, e.g., at sites where landscaping or construction activities are occurring. When used for this purpose, buckets, or scoops, are attached to the utility vehicles. These buckets usually have a front edge, or lip, which is the only surface adapted to make cuts into soil being graded. When using a prior art combination of a utility vehicle and bucket without the presence of this invention, the bucket, when being operated substantially horizontally to the soil being graded, can cut into the soil only when traveling forward. The prior art combination is further limited by a difficulty to control the depth of the cut being made. When being operated in a rearward direction in a horizontal orientation, the prior art bucket can level and compact the soil, but cannot make a cut. When the front of the prior art bucket is tilted toward the soil being graded, the bucket can make cuts even in compacted soils when being operated in a forward direction and can only level and compact the graded soil when being operated in a rearward direction. However, it is often difficult to control the degree of tilt, hence the depth of cut being made. Thus, when being used to grade soil, the prior art combinations are limited to making cuts in only when being operated in a forward direction, often with choppy, uneven results because of the difficulty in controlling the depth of the cut being made. The prior art combinations are further limited to only leveling and compacting soil when traveling in a rearward direction.

There is then a need for a utility bucket attachment to enable precision grading to occur when the utility vehicle is driven in either direction. There is another need for a utility bucket attachment with a grading blade with two operable grading edges, the grading blade being detachable so as to use either grading edge or so as to be replaced. There is still another need for a utility bucket attachment with a vertically adjustable grading blade.

SUMMARY OF THE INVENTION

This invention substantially meets the aforementioned needs of the industry by providing a grading assembly, the grading assembly including a detachable grading element and a securing assembly. The grading element may define generally opposed first and second grading edges. The securing assembly may be configured for securing the grading element so that either the first or second grading edges thereof are in a grading position. The securing assembly may be attachable to a utility bucket and may include first and second holders and an adjusting mechanism. The first and second holders may be operably attached to a rear portion of the utility bucket in a spaced-apart relationship, so as to accommodate and secure the grading element therebetween. A plurality of gussets may be used to attach and further brace the first holder or the second holder to the utility bucket. The adjusting mechanism may include an adjustment member, which may be attachable in rigid juxtaposition to the grading element. In one embodiment, the adjustment member is attached to the grading element by one or more bolts. The adjustment member may define a pair of openings accommodating the bolts, thereby attaching the adjustment member to the grading element. The adjustment member may further define another opening accommodating another bolt, which may be threadably received within a nut, the nut attached to the adjustment member. The grading element may be adjusted vertically by rotating the other bolt, thereby displacing the adjustment member vertically as the second bolt rotating the contacts a plate affixed to the utility bucket and oriented orthogonally with respect to the second bolt. In the context of the present invention, the grading element, with two generally opposed grading edges, may be removed for repair, replacement or rotation, thereby using either grading edge.

It is a first object of the present invention to provide a grading assembly to enable a utility bucket to be used for precision grading when the utility vehicle is operated in either the forward or rearward direction.

It is a second object of the present invention to provide a grading assembly having a grading blade with a pair of generally opposed grading edges, the grading assembly configured so that either grading edge can be used.

It is a third object of the present invention to provide a grading assembly having a grading blade, which is removable, thereby enabling repair or replacement.

It is a fourth object of the present invention to provide a grading assembly with a vertically adjustable grading element.

It is a fifth object of the present invention to provide a grading assembly with a continuously adjustable grading element.

It is a sixth object of the present invention to provide a grading assembly, which is mountable to a rear portion of the utility bucket.

It is a seventh object of the present invention to provide a grading assembly, which is mounted and braced to a rear portion of a utility bucket, so that the grading element is stable under a variety of soil types and conditions.

These and other objects, features, and advantages of this invention will become apparent from the description which follows, when considered in view of the accompanying drawings.

Figure 1:
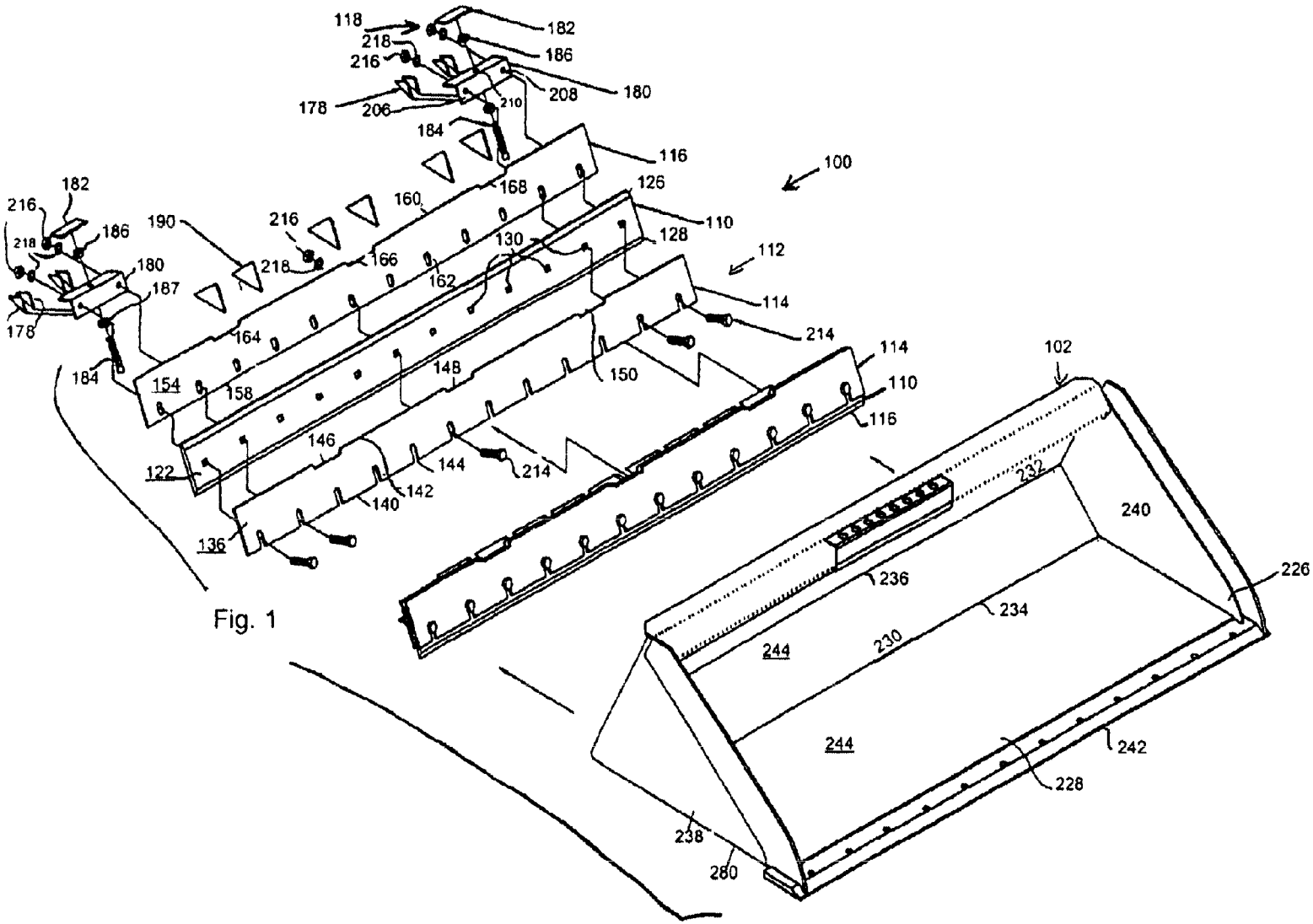
FIG. 1 is an exploded view of one embodiment of the present grading assembly.
Figure 2:
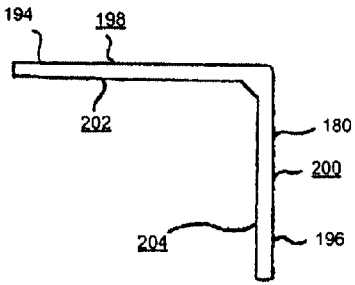
FIG. 2 is a side view of an adjustment member of the embodiment of FIG. 1.

It is understood that the above-described figures are only illustrative of the present invention and are not contemplated to limit the scope thereof

DETAILED DESCRIPTION OF THE INVENTION/DRAWINGS

Comprehension of this invention can be gained through reference to the drawings in conjunction with a thorough review of the following explanation. All dimensions of the components in the attached figures may vary with a potential design and the intended use of an embodiment of the invention without departing from the scope of the invention.

A grading assembly of the present intention is indicated generally at 100 in the drawings. The grading assembly 100 operationally attaches to a utility bucket, indicated at 102. The utility bucket, in turn, is operationally attached to a utility vehicle, such as a "skid steer." It is understood that the utility bucket depicted is only one example of several utility buckets to which the present grading assembly can be mounted and that persons of ordinary skill in the art will readily comprehend how to mount the present grading assembly to many other utility bucket embodiments. The grading assembly 100 may include a grading element, such as a blade 110. The blade 110 is operationally attached to the utility bucket 102 with a securing assembly 112. The securing assembly 112, in turn, includes respective first and second holders 114 and 116 and one or more adjusting mechanisms 118.

The blade 110 displays respective first and second surfaces 122 and 124 and opposing first and second edges 126 and 128 and may define one or more apertures 130. The first and second edges 126 and 128 are beveled in this embodiment. However, one or both of the edges 126 and 128 may be orthogonal to one or both of the surfaces 122 and 124 in other embodiments. Moreover, in some embodiments it may be advantageous for other geometries to be present proximate the first and/or second edges 126 and 128, e.g., serrated, fluted. The apertures 130 are generally square in the embodiment depicted, but may have other geometries, e.g., round, slotted. If present, slotted geometries would enable an alternate depth-adjusting mechanism (discussed below). While the blade 110 can have various dimensions, a thickness of ⅝ inch has been found to be satisfactory. However, a person of ordinary skill in the art will appreciate that the thickness of the blade 110 could be altered to accommodate other variables, e.g., utility bucket dimensions, texture and/or degree of compaction of soil to be graded. The width of the blade 110 is determined by the dimensions of the utility bucket to which the present blade is to be mounted.

The first holder 114 displays respective first and second surfaces 136 and 138 (not shown) and opposing first and second edges 140 and 142. One or more slots 144 extend from the first edge 140 and a plurality of recesses, e.g., recesses 146, 148, and 150, extend from the second edge 142. Alternately, the cross-sectional geometry of the slots may be round, square, or the like if an alternate depth-adjusting mechanism (discussed below) is employed.

The second holder 116 displays respective first and second surfaces 154 and 156 and generally opposing first and second edges 158 and 160, respectively. One or more slots 162 may be defined proximate the first edge 158 and one or more recesses, e.g., recesses 164, 166, and 168, may extend from the second edge 160. Alternately, the cross-sectional geometry of the slots may be round, square, or the like, if an alternate depth-adjusting mechanism (discussed below) is employed. The slots 144 and 162 of the first and second holders 114 and 116 are dimensioned and disposed to align with the apertures 130 of the blade 110 and the recesses 146, 148, and 150 of the first holder 114 are dimensioned and disposed to align with the respective recesses 164, 166, and 168 of the second holder 116 in this embodiment.

Each adjusting mechanism 118 may include a stabilizer such as one or more gussets 178, an adjustable member such as angle iron 180, a plate 182, an adjustable connector such as a bolt 184, and one or more threaded members such as nut 186 and 187. Additionally, one or more braces, such as gussets 190, may be present as well. In the embodiment depicted the gussets 190 are generally triangular. The dimensions of the edges of the gussets 190 may be varied depending on the desired angle at which the present grading system is mounted to the bucket 102, e.g., 65 (+/−5, 10, 15) degrees from the lower edges (278, 280) of the bucket end plates (238, 240), described more fully below. The gussets 178 are attached to angle iron 180, e.g., by welds, to provide support and rigidity to the present grading assembly during operation. In this embodiment, the angle iron 180 may be considered to include unitary (or otherwise integral) respective first and second members 194 and 196. The first and second members 194 and 196 may display respective first surfaces 198 and 200 and second surfaces 202 and 204. One or more apertures, e.g., apertures 206 and 208 may be defined in the second member 196 and an aperture 210 may be defined in the first member 194. The apertures 206 and 208 are situated on the second member 196 so as to align with slots 144 and 162 of the first and second holders 114 and 116 and with apertures 130 of the blade 110. Threads (not shown) may be present proximate the aperture 210. If threads are present, the nut 186 may not be necessary.

The blade 110 is operationally secured between the first and second holders 114 and 116 by aligning the apertures 130 with the slots 144 and 162 of the first and second holders 114 and 116, then extending connectors, such as bolts 214, therethrough and securing the bolts with nuts (or lock nuts) 216 and lock washers 218. When the blade 110 is placed between the first and second holders 114 and 116 as described above, the holders are in a spaced (e.g., about ⅝ inch), generally parallel relation to each other and will allow the blade to be vertically adjusted to desired depths and will further allow the blade to be removed and reinserted as described below. Thusly assembled, the grading element 110 and first and second holders 114 and 116 are mounted to a rear portion of the utility bucket 102 in a manner such as that discussed below.

The utility bucket depicted at 102 has a cavity 226 defined by unitarily (or otherwise integrally) joined first, second, and third plates 228, 230, and 232, respectively. Plates 228 and 230 are joined at a bend 234 and plates 230 and 232 are joined at a bend 236. The cavity 226 is further defined by end plates 238 and 240. A front lip 242 is present on the embodiment shown. The second plate 230 may be considered to display respective first and second surfaces 244 and 246. The plate 228 defines a floor of the bucket cavity and the respective plates 230 and 232 define the rear and upper bounds of the cavity 226. Wear bars 248, 250, and 252 are present to protect and support the first and second plates 228 and 230. The wear bars 248, 250, and 252 extend rearwardly from the lip 242 and contain respective bends 254, 256, and 258 so as to support the plate 230. A mounting assembly 260 is operably attached to the rear of the bucket 102 and includes brackets 262 and 264. Brackets 262 and 264 are attached and supported by gussets 266, 268, 270, and 272.

When the blade 110 and attached first and second holders 114 and 116 are disposed in a rear portion of the utility bucket 102, the recesses 146, 148, and 150 of the first holder 114 and the recesses 164, 166, and 168 of the second holder 116 will accommodate the respective wear bars 248, 250, and 252. After the blade 110, first holder 114, and second holder 116 are disposed in the rear of the utility bucket 102 as described above, the adjusting mechanisms 118 are attached thereto. The bolt 184 is extended through the aperture 210 and threaded into the nuts 186 and 187. The nut 186 may then be secured to the first member 194 of the angle iron 180, e.g., by a weld. Then the gussets 178 are affixed, e.g., by welds to the angle iron 180. In the embodiment depicted, the gussets 178 are welded to the angle iron 180 on each side of apertures 208 and 210. Bolts 214 are extended through slots 144 of the first holder 114, apertures 130 of the blade 110, slots 162 of the second holder 116, and apertures 206 and 208 of the angle iron 180, then secured thereto with nuts 216 and lock washers 218. The gussets 190 are welded onto the surface 136 of the first holder 114. The foregoing assembled components are then disposed in a rear portion of the utility bucket 102, such that free edges of the gussets 190 contact the second surfaces 246 of the plate 230. The gussets 190 are then attached, e.g., by welding, to the plate 230 and the first and second holders 114 and 116 are also attached, e.g., welded, to the plate 230 such as second edges 142 and 160. The plate 182 is also attached, e.g., welded, to the plate 230 and first holder 114 so as to be orthogonal to the bolt 184 and to provide a flat surface abutting the bolt 184 when the blade 110 is vertically adjusted.

Figure 3:
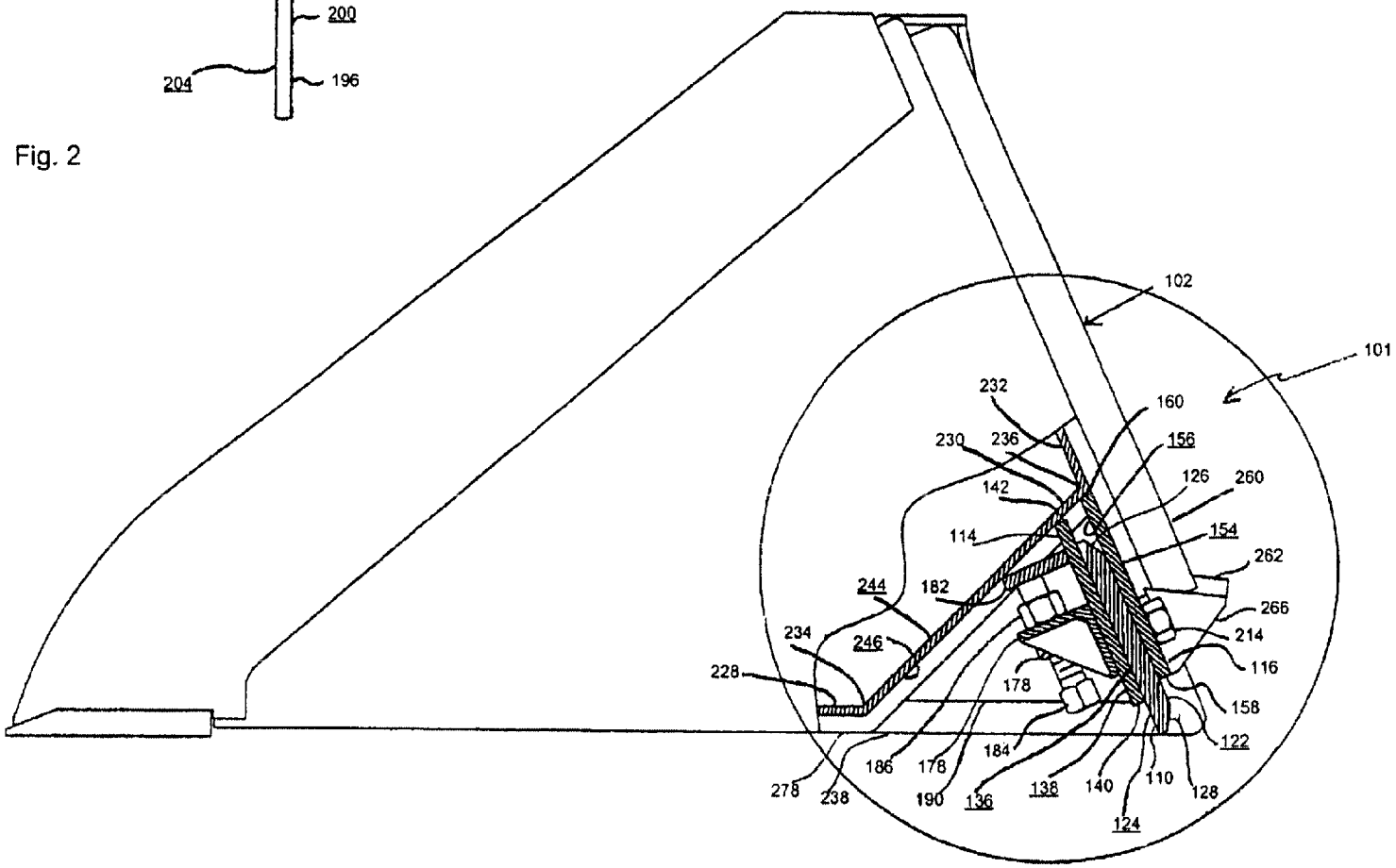
FIG. 3 is a cross sectional side view of the embodiment of FIG. 1 mounted to a rear portion of a utility bucket.
Figure 4:
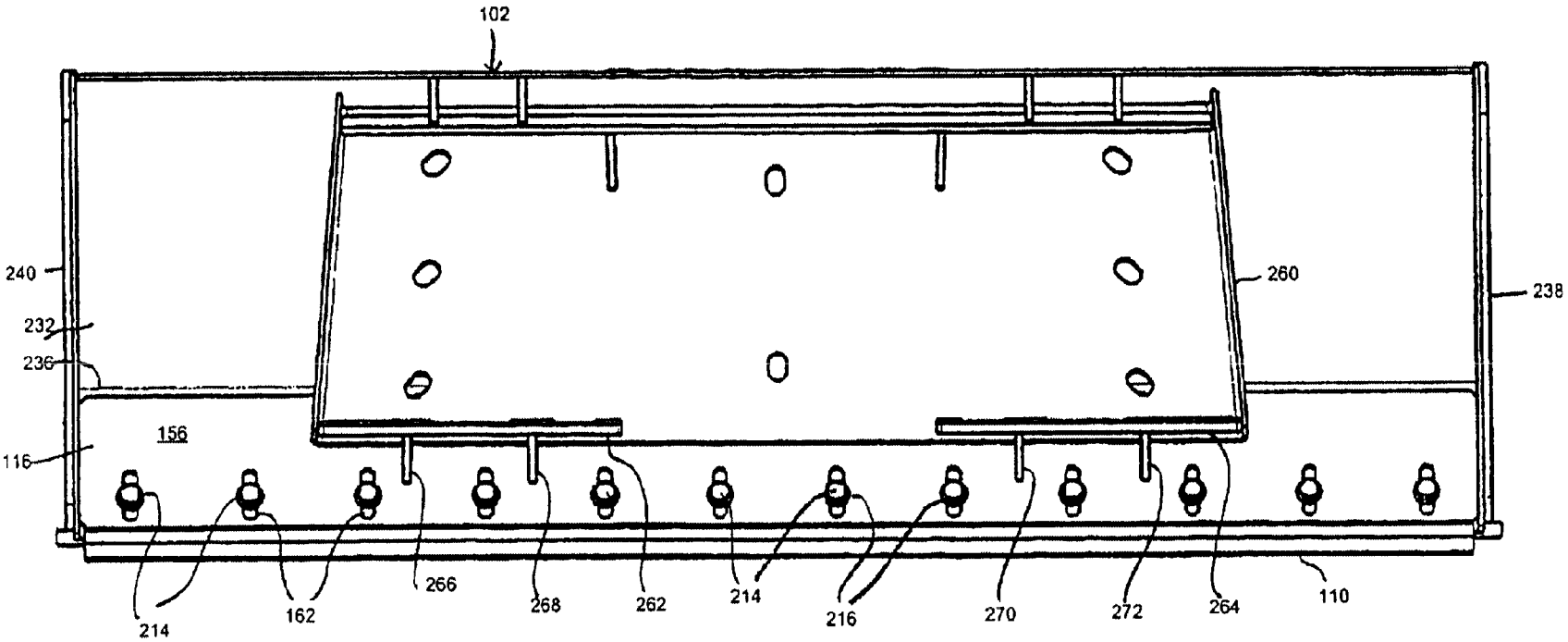
FIG. 4 is a rear view of the embodiment of FIG. 1 mounted on the utility bucket of FIG. 3.
Figure 5:
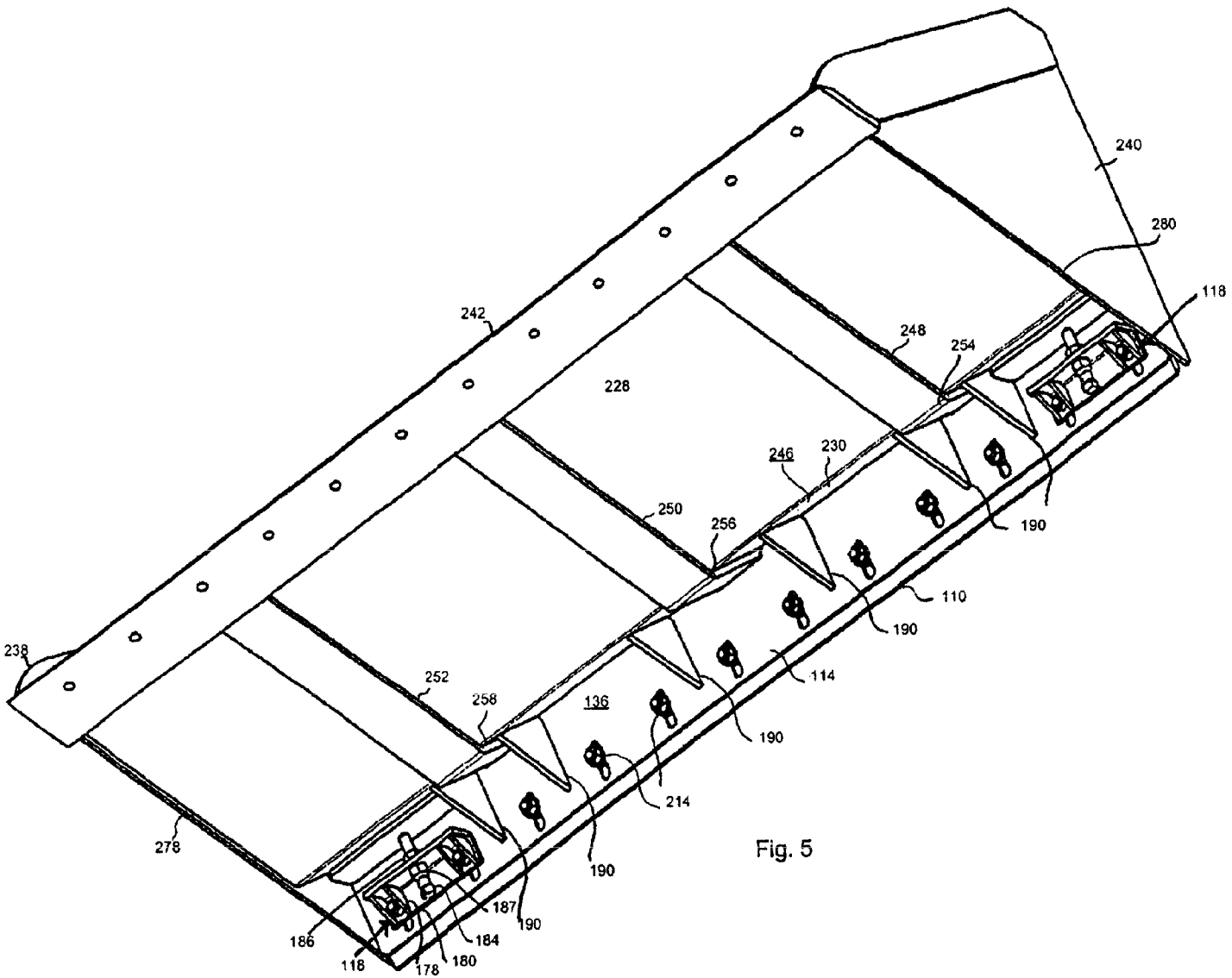
FIG. 5 is a bottom perspective view of the embodiment of FIG. I mounted on the utility bucket of FIG. 3.
Figure 6:
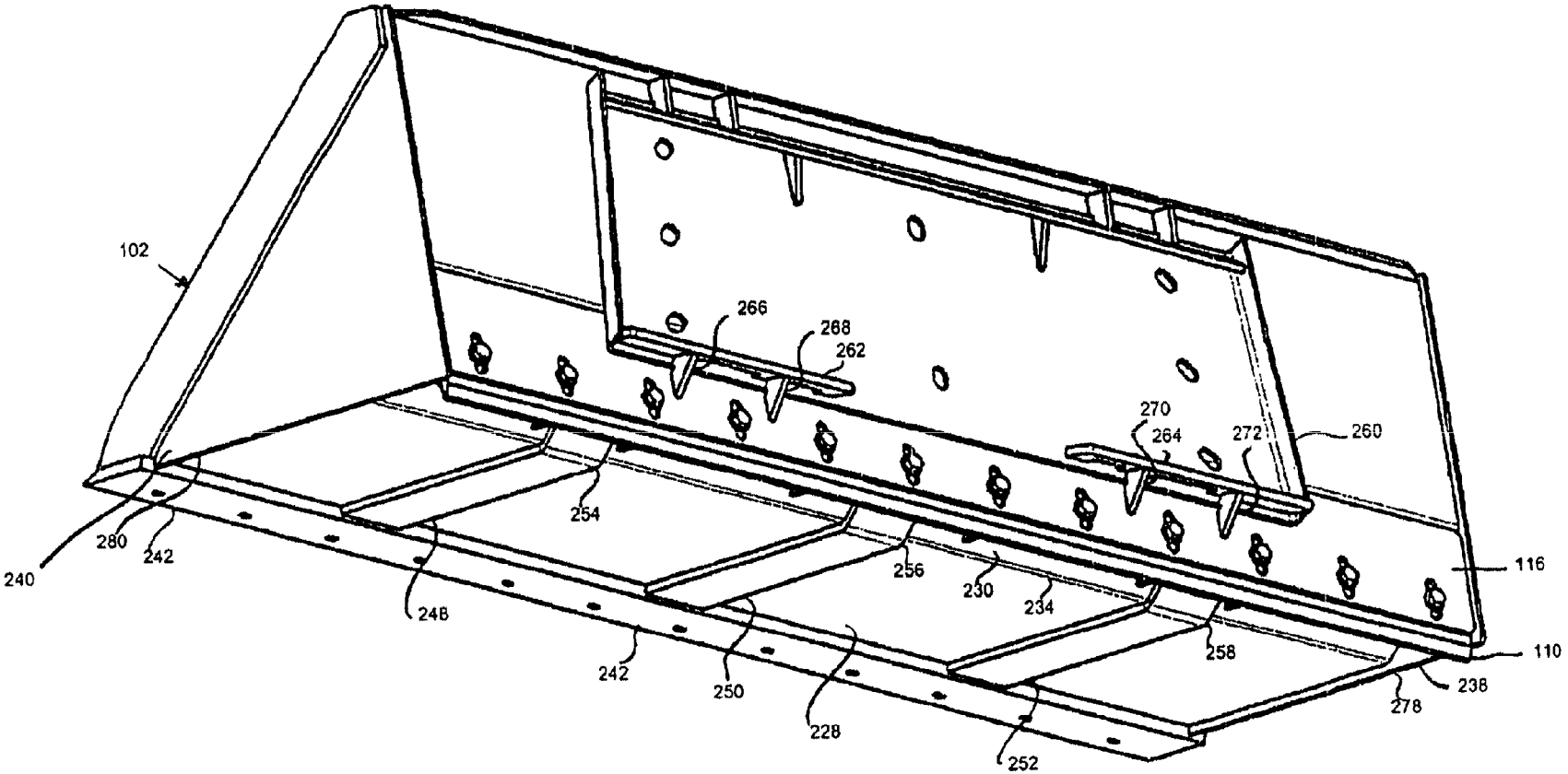
FIG. 6 is a rear perspective view of the embodiment of FIG. I mounted on the utility bucket of FIG. 3.

As shown in FIG. 3, the blade 110 is at the top of a substantially continuous adjustment range, with the lower edge 128 of the blade 110 generally parallel with the lower edges 278 and 280 of the end plates 238 and 240. However, the blade 110, hence edges 126 and 128, can be adjusted generally continuously downwardly, e.g., 1½ inches in this embodiment. Adjusting the depths of the blade edges 126 and 128 is effected by loosening the nuts 187 and 216 and rotating the adjusting bolts 184. In this embodiment, rotating the adjusting bolts 184 clockwise will adjust the blade edges 126 or 128 downwardly. Rotating the adjusting bolts 184 counterclockwise will adjust the blade edges 126 or 128 upwardly (although an operator may have to manually displace the blade 110 upwardly). Upward or downward movement of the blade 110 is effected because the bolts 214 are substantially snugly accommodated within the apertures 130 of the blade 110 and 206 and 208 of the angle iron 180. Hence, the angle iron 180 and blade 110 are in a substantially rigid and juxtapositional relation. Thus, when moved upwardly or downwardly by rotating the adjustment bolt 184, the bolts slide within the slots 144 and 162 of the first and second holders 114 and 116, thereby moving the blade and angle-iron up or down with respect to the stationarily mounted first and second holders 114 and 116. When the present blade edge is at a desired depth, the bolts 187 and 214 are then tightened to further secure the blade 110 in position. As described above, the apertures 130 may be slotted and the slots 144 and 162 on the holders 114 and 116 may be replaced by round or square apertures. In this alternate embodiment, the adjustment mechanism 118 may not be necessary. Instead, the bolts 214 are loosened, the blade 110 is manually adjusted for the desired depth, and the bolts 214 are then retightened.

The blade 110 may be removed and reversed such that either edge 126 or 128 can be used for grading or to allow the blade 110 to be repaired or replaced. To remove the blade 110, the bolts 214 are loosened from the nuts 216, then completely removed. Removing the bolts 214 allows the blade 110 to be removed and detaches angle irons 180 therefrom. The blade 110 is then removed, rotated so that the other blade edge 126 or 128 will be used for grading, and reinserted between the holders 114 and 116. The bolts 214 are then reinserted and tightened onto the nuts 216. The adjustment bolt 184 is rotated until the edge 126 or 128 is at a desired depth. Then, the bolts 187 and 214 are tightened to hold the blade 110 firmly in place.

In use, the present grading assembly permits precision grading to be conducted in either the forward or rearward directions. For example, in the forward direction, the bucket lip 242 is used to grade the soil profile and in the rearward direction the present blade, mounted as explained above, is used to perform the grading operation. The present grading blade can be adjusted to a desired depth, e.g., continuously over a 1½-inch vertical adjustment dimension. Moreover, the present blade can be removed for repair or replacement.

With a given blade depth adjustment, a utility vehicle and bucket retrofitted with the present invention may be operated in a forward direction with the front lip slightly elevated to effect a cut with a substantially precise depth determined by the degree of tilt. When operated in this manner, a precise cut and degree of leveling are effected; the lip and blade cooperating to provide a smoother, more uniform cut. Moreover, soil overflow from the cut will be forced into the bucket to be deposited elsewhere, thereby eliminating or minimizing the need for leveling and compaction present in prior art combinations. When buckets retrofitted with the present invention are operated backwardly with the lip tilted downwardly (blade slightly elevated), precision cutting and leveling can also be performed to achieve a smoother grade. When operated in a rearward direction with the front edge more significantly elevated, the blade performs uniform cuts into soils with greater degrees of compaction to result in more precise leveling that heretofore possible.

Because numerous modifications of this invention may be made without departing from the spirit thereof, the scope of the invention is not to be limited to the embodiments illustrated and described. Rather, the scope of the invention is to be determined by the appended claims

What is claimed is:

1. A grading assembly, comprising:

a detachable grading element defining a first edge and a second edge; and a securing assembly for securing the grading element in one of a first operational position and a second operational position, the first operational position disposing the grading element first edge in a grading position and the second operational position disposing the grading element second edge in said grading position, the securing assembly comprising a first holder, a second holder, and a plurality of connectors, the first and second holders accommodating the grading element therebetween, the plurality of connectors securing the first and second holders to the grading element.

2. The grading assembly of claim 1, the grading element first edge oppositely disposed to the grading element second edge.

3. The grading assembly of claim 1, the securing assembly securing the grading element at an adjustable depth.

4. The grading assembly of claim 1, the securing assembly securing the grading element at a continuously adjustable depth.

5. The grading assembly of claim 1 the securing assembly further comprising a first plurality of apertures defined in the first holder, a second plurality of apertures defined in the second holder, and a third plurality of apertures defined in the grading element, ones of said first, second, and third pluralities of apertures generally aligned.

6. The grading assembly of claim 5, in which the first and second pluralities of apertures are slots.

7. The grading assembly of claim 6, the securing assembly further comprising an adjustment member and a threaded connector.

8. The grading assembly of claim 7, the adjustment member defining a threaded aperture, the threaded aperture threadably accommodating one of the connectors, the adjustment member and the grading element in a substantially rigid juxtaposition.

9. The grading assembly of claim 7, the securing assembly further comprising a nut threadably receiving the one of the connectors and attachable to the adjustment member.

10. The grading assembly of claim 9, the adjustment member comprising an angle iron.

11. The grading assembly of claim 10, the securing assembly further comprising a first stabilizer attachable to the angle-iron.

12. The grading assembly of claim 11, further comprising a plurality of second stabilizers attachable to one of the first and second holders.

13. A utility bucket in combination with the grading assembly of claim 1, said grading assembly operationally mounted to the utility bucket.

14. A utility bucket in combination with the grading assembly of claim 1, said grading assembly operationally mounted to a rear portion of the utility bucket.

15. A grading assembly, comprising:

a utility bucket;

a detachable grading blade with generally opposite first and second edges; and mounting structure for releasably attaching the grading blade to a rear portion of the utility bucket and including first and second holders and a plurality of first connectors, said first and second holders defining slotted openings positionally, operationally adjusting a grading depth of the grading blade, the first connectors holding the grading blade operationally between the first and second holders.

16. The grading assembly of claim 15, the first holder defining a plurality of first apertures, the second holder defining a plurality of second apertures, and the grading blade defining a plurality of third apertures, each of the third apertures generally aligning with one of the first and second apertures and receiving one of the first connectors.

17. The grading assembly of claim 16, in which the first and second pluralities of apertures are slotted.

18. The grading assembly of claim 17, the mounting structure further comprising a plurality of adjustment members, each adjustment member comprising means for continuously adjusting the grading depth.

19. The grading assembly of claim 18, the means for continuously adjusting the grading depth comprising fourth and fifth apertures, a second connector and a member threadably receiving the second connector, the fourth aperture receiving one of the first connectors to rigidly attach the adjustment member to the grading blade, the fifth aperture receiving the second connector.

20. The grading assembly of claim 18, further comprising means for stabilizing and bracing the mounting structure to a rear portion of the utility bucket.

21. The grading assembly of claim 15, in which the grading blade and the mounting structure are mounted to a rear portion of the utility bucket.

22. A method of assembling a grading assembly, comprising:

providing a grading blade with generally opposite first and second grading edges and a plurality of apertures defined therein;

disposing the grading blade between a first holder and a second holder, each of the first and second holders defining a plurality of slots, each of the grading edge apertures generally aligning with one of the first holder slots and one of the second holder slots;

securing a first connector through each of said aligned first and second holder slots and grading blade apertures;

attaching one of the first and second holders to a mar portion of a utility bucket;

fixing a plurality of adjustment members in a rigid juxtaposition to the grading blade; and threadably attaching a second connector to each of the adjustment members.

23. The method of claim 22, in which each of the first connectors are secured through said first and second holders and said grading blade with a nut.

24. The method of claim 22, in which each of said second connectors is threadably received by a nut attached to one of said adjustment members.

25. The method of claim 24, further comprising attaching a plurality of first stabilizers to each of the adjustment members.

26. The method of claim 25, further comprising attaching a plurality of second stabilizers to the utility bucket and to one of said first and second holders.

27. A method of adjusting a grading depth of a grading blade attached to a rear portion of a utility bucket, the grading blade disposed between a pair of holders, each of said holders defining a plurality of slots, said grading blade defining a plurality of apertures, said grading blade secured between said pair of holders by a plurality of first connectors, one of said first connectors extending through one of said grading blade apertures and one each of said first and second holder slots, said grading blade rigidly related to a plurality of adjustment members by another one of said first connectors extending through another one of said first and second holder slots, through another one of said grading glade apertures, and through an aperture defined in said adjustment member and secured therein, the method comprising:

releasing each of said first connectors;

rotating each of a plurality of second connectors, each said second connector extending through a second aperture defined in each adjustment member and threadably received in a nut, said second connector abutting a plate attached to the utility bucket; and resecuring each of said first connectors.

28. The method of claim 27, in which each of said second connectors is rotated in a first direction, thereby raising the grading blade.

29. The method of claim 28, in which each of said second connectors is rotated in a second direction, thereby lowering the grading blade.

* * * * *